US006105398A

United States Patent [19]

Leins et al.

[11] Patent Number: 6,105,398

[45] Date of Patent: Aug. 22, 2000

[54] POSITIVE FEED MECHANISM FOR ELASTIC YARNS

[75] Inventors: Eberhard Leins; Hermann Schmodde, both of Horb-Dettlingen, Germany

[73] Assignee: Memminger-Iro GmbH, Dornstetten, Germany

[21] Appl. No.: 09/275,460

[22] Filed: Mar. 24, 1999

[30] Foreign Application Priority Data

Mar. 26, 1998 [DE] Germany ..... 198 13 351

[51] Int. Cl.[7] ..... B65H 59/38; B65H 51/22; D02G 3/32; D04B 15/50

[52] U.S. Cl. ..... 66/132 R

[58] Field of Search ..... 66/132 R; 242/365.7

[56] References Cited

U.S. PATENT DOCUMENTS

| | | | |
|---|---|---|---|
| 3,700,153 | 10/1972 | Delair et al. | 66/132 R |
| 3,962,891 | 6/1976 | Rouzaud | 66/139 R |
| 4,673,139 | 6/1987 | Memminger et al. | 66/132 R |
| 4,752,044 | 6/1988 | Memminger et al. | 66/132 R |
| 4,953,367 | 9/1990 | Memminger et al. . | |

FOREIGN PATENT DOCUMENTS

| | | |
|---|---|---|
| 0499380 B1 | 4/1997 | European Pat. Off. . |
| 1 585 111 | 4/1971 | Germany . |
| 42 06 607 A1 | 4/1993 | Germany . |
| WO 97/13907 | 4/1997 | WIPO . |

*Primary Examiner*—Andy Falik
*Attorney, Agent, or Firm*—Frishauf, Holtz, Goodman, Langer & Chick, P.C.

[57] ABSTRACT

A yarn feeder device for feeding elastic (soft) yarns to a yarn consuming station whose yarn demand fluctuates over time. The device has a control unit which ascertains the current yarn demand or to which the current yarn demand is reported. In accordance with this demand, a yarn feed wheel is driven at a rotary speed suitable for the yarn demand. The yarn travels via a tensioning device to the yarn feed wheel. The tensioning device is arranged such that the yarn is stretched in a defined way. As a result, a fixed association between a desired yarn feed quantity and the rotary speed of the yarn feed wheel is enabled.

13 Claims, 3 Drawing Sheets

POSITIVE FEED MECHANISM FOR ELASTIC YARNS

FIELD OF THE INVENTION

The invention relates to a positive feed mechanism, which is intended in particular for elastic yarns and for furnishing yarn-consuming stations that have a yarn demand that fluctuates over time.

BACKGROUND OF THE INVENTION

Elastic threads or yarns change their length depending on the tension they are subject to, and even very great changes in length are possible. For instance, elastomer yarns are now being used that can be stretched to seven times their original length, or even more. Therefore, the yarn quantity furnished depends greatly on the tension at which the yarn is fed. While in many cases it suffices for the tension of the elastic yarn to be kept constant within specific limits, there are a number of applications in which it is important for a predetermined yarn quantity to be furnished within a predetermined time interval. The yarn quantity is defined for instance by a yarn length at a specified yarn tension. If the yarn is very elastic, it cannot be guaranteed that a certain yarn quantity will be furnished.

While in some applications the yarn demand is constant over time, there are many applications in which the yarn demand fluctuates very greatly over time. Examples are flatbed knitting machines and similar knitting machines, circular knitting machines with pattern equipment, stocking knitting machines, and so forth. A knitted product must often be made on these machines in which the elastic yarn is knitted together with one or more inelastic yarns, so-called hard yarns. This must be done with proportional quantity in many cases; that is, for a given quantity of hard yarn, a corresponding quantity of elastic yarn must be furnished positively and with as much as possible the same speed profile. This is relatively difficult because of the different qualities. It has been found that synchronized quantitative feeding of hard and soft yarns is relatively difficult, at least whenever yarn consumption is fluctuating.

From German Patent Disclosure DE 38 24 03, a yarn feeder for fluctuating yarn demand is known. The yarn feeder has a yarn feed wheel, driven by a stepping motor, whose outer circumference is defined by six wire brackets. A yarn brake is disposed upstream of the yarn feed wheel in terms of the yarn travel. The yarn feed wheel is followed by a yarn tension sensor for regulating the stepping motor and thus the yarn quantity. The yarn feeder serves to feed yarn at a constant tension.

From German Patent Disclosure DE 42 06 607 A1, a yarn feeder is known that is intended to furnish time-varying quantities of elastic yarns. The yarn feeder has a disk rotor motor, which is connected to a yarn feed wheel. The yarn to be furnished wraps around the yarn feed wheel. A fixedly set yarn brake is disposed upstream of the yarn feed wheel and contains a permanent magnet to generate the braking action or an electromagnet for adjustably generating this action. To monitor the yarn tension and keep it constant, the yarn feed wheel is followed by a yarn tension sensor which controls the disk rotor motor.

The yarn feeder serves to feed elastic yarns at a more or less constant tension, but not to positively feed fixed yarn quantities.

From European Patent Disclosure EP 0 499 380 A1, the supply of elastic yarns to a yarn consuming station with constant yarn consumption is known. The yarn feeder device includes two yarn feeders operating independently of one another through which the yarn passes in succession. First, it is guided by a yarn feeder that draws the yarn from bobbins. The yarn feed wheel is driven by an electric motor, which is triggered in accordance with the yarn tension detected by a yarn tension sensor disposed just downstream of the yarn feed wheel. Thus the yarn is fed at more or less constant tension to two yarn feed wheels or rollers in frictional engagement with one another, which are driven at a fixed rpm and thus furnish constant yarn quantities. Yarn quantities that are constant over time are thus carried to a yarn consuming station, in which the elastic yarn is combined with a hard yarn.

This arrangement is not set up to furnish varying yarn quantities over time. A yarn feeder device is also known from Published, Examined German Patent Application DE-AS 158 5111, for furnishing yarns to a knitting machine at a constant yarn speed and at the same time at a constant yarn tension. This yarn feeder apparatus has two uniformly driven conical rollers around which the yarn wraps one after the other. In the process, the yarn passes through one yarn guide for each roller, and the yarn guide defines the diameter at which the yarn rolls onto the roller and off again. By defining the two payout diameters differently, it is possible for the yarn first to be drawn from the bobbin at a small roller diameter and then taken from the next roller with a larger diameter, so that the yarn is greatly stretched between the rollers. In the portion following the second roller, the yarn is relaxed again, utilizing a hysteresis effect of the kinky yarn. This hysteresis effect that can be observed in kinky yarns means that after the second roller, in the relaxed state, the yarn is hardly shortened at all. It should be more easily worked in that state.

This apparatus and the method have been developed especially for processing constant quantities over time of curled yarns with a hysteresis effect.

SUMMARY OF THE INVENTION

An object of the invention is to create a yarn feeder with which variably defined quantities of elastic yarns over time can be fed to yarn consuming stations. It is also an object of the invention to provide a corresponding method.

These objects are attained with a yarn feeder having a tensioning device which imparts a defined tension to a yarn arriving from a bobbin. The yarn feeder operates under tension guidance on the inlet side and under quantity guidance on the output side. An at least relatively constant yarn tension is brought about between the tensioning device and the positive feeder. Fluctuations in tension that can be caused by factors outside the yarn feeder, such as varying yarn friction at yarn eyelets along the way to a yarn consuming station, are kept from affecting the tension-controlled travel segment between the tensioning device and a positive feeder. Thus, yarn feeding with a defined quantity of elastic yarn can be done regardless of friction factors downstream of the yarn feeder. This is true particularly when the yarn demand fluctuates over time. The yarn travel conditions are then speed-dependent. Separating the yarn travel region downstream of the yarn feeder from the tension-set travel segment here makes it possible to feed yarn quantities that fluctuate over time but in a controlled, correct way.

The tensioning device may be arranged for the nonlinear force-travel relationship as it is encountered in elastic yarns. Conventional elastic yarns, such as Spandex™ yarns, have major elongation changes in the range of slight forces when only slight changes in force occur. As the tensile force or the force in the longitudinal direction of the yarn increases, the changes in length that occur become less and less, however. Once the yarn has reached its maximum elongation, any further increase in the force can no longer bring about any significant stretching of the yarn. If the force is removed, however, the yarn immediately largely resumes its original length. This property as a rule makes it relatively difficult to feed predetermined yarn quantities. The tensioning device present in the yarn feeder of the invention circumvents these problems by stretching the yarn so greatly that any change in yarn tension has hardly any further influence on yarn length. In this stretched state, the yarn is furnished to the yarn feed wheel, which is driven by an electric motor to suit the current yarn demand and thus furnishes the desired quantity independently of the resultant yarn tension. Quantity-defined yarn feeding is also known as positive feeding and is thus in a way contrary to yarn feeders that feed yarns at a constant (low) tension, which are known as negative feeder mechanisms.

The yarn feed wheel is driven by a motor independently of the tensioning device. Thus, the tensioning device can be designed such that it creates a high yarn tension independently of the operation of the yarn feed wheel.

By way of example, the tensioning device can be a kind of yarn brake, which operates independently of the yarn travel speed. For instance, it can be a friction brake, in which the yarn is braked by friction elements along which it slides. If the yarn brake generates a more or less constant yarn tension, then a relatively wide yarn tension range can be allowed here without markedly changing the furnished yarn quantity. This is a consequence of the tension of the yarn up to its maximum limit.

Alternatively, the tensioning device may be a regulated yarn brake, which is set for instance in accordance with the yarn tension between the yarn brake and the yarn feed wheel. This makes it possible to compensate for additional frictional factors that can result, for instance, upstream of the yarn feeder. Furthermore, the capability of the device to react to abrupt changes in demand is improved.

Surprisingly, both with a regulated and an unregulated tensioning device an improvement in the dynamic properties of the yarn feeder is possible. When the yarn feed wheel is speeded up, the tensed yarn upstream of the yarn feed wheel behaves like a hard yarn, in which tension changes do not cause stretching that could change the furnished quantity. For this reason, regulating operations upstream of the yarn feed wheel impair the precision with regard to the desired furnished yarn quantity, in particular during transitional events upon acceleration or deceleration of the yarn feed wheel, very little if at all.

For the yarn brake, various designs can be considered. For instance, it is possible to use a simple friction brake with two brake adjusters. These adjusters can be tensed against one another by a spring or by magnets. To that end, an electric magnet or other electrically controllable means can also be used, which are triggered for instance by the closed control loop. Instead of the yarn brakes, a separate yarn feed wheel may also be provided as the tensioning device, which has its own drive motor. This second yarn feed wheel has the task of drawing the yarn from a bobbin and feeding it at a defined tension, in the stretched state, to the downstream yarn feed wheel in terms of the direction of motion of the yarn, while the upstream yarn feed wheel is connected to a motor that preferably operates in tension-guided fashion, while the motor of the downstream yarn feed wheel preferably is quantity-guided. This is correspondingly true for the embodiment, discussed earlier herein with a controlled brake. In this way, with the yarn feeder of the invention, positive feeding of elastic yarns is possible to suit yarn supply demand which fluctuates with time. Tension sensors downstream of the yarn feed wheel around which the stretched yarn wraps can be dispensed with. While the tensioning device may operate in a fixedly set manner or with regulation on the basis of the yarn tension, the yarn feed wheel following the tensioning device is preferably operated in an open-loop control chain. This makes it possible to react to altered yarn tension requirements, without hunting.

Furthermore, the positive feeding can be initiated as soon as, or before, an abrupt increase in yarn demand occurs, or in other words even before tension changes are detectable in the travel segment between the yarn feed wheel and the yarn consuming station.

The yarn feeder is preferably connected to a control unit or has a control unit that triggers the motor of the yarn feed wheel at the rpm suited to the desired yarn feeding. The control unit can contain the data from a pattern data memory, for instance. In flatbed knitting machines it can be suitable to derive the yarn demand from the motion of the yarn guide, which in the simplest case is detected with light gates, end switches or the like. It can also be expedient to determine the demand for elastic yarn by measuring the travel speed of another kind of yarn, such as a hard yarn, that is to be handled by the applicable machine. To that end, a measuring device for the yarn speed can be provided that is connected to the control unit. This then makes it possible to furnish the elastic yarn to a yarn consuming station, for instance in a strictly proportional quantity with respect to another kind of yarn. The sensor device is for instance a small measuring wheel, around which the other kind of yarn (hard yarn) wraps, and which is seated on the shaft of an encoder.

The control unit can also be connected to the tensioning device to regulate it. For instance, the control unit is then connected to suitable electric adjusting devices of the brakes or to the motor of a corresponding yarn feed wheel and a tension sensor, which is disposed between the tensioning device and the yarn feed wheel.

DETAILED DESCRIPTION OF THE INVENTION

Figure 1:
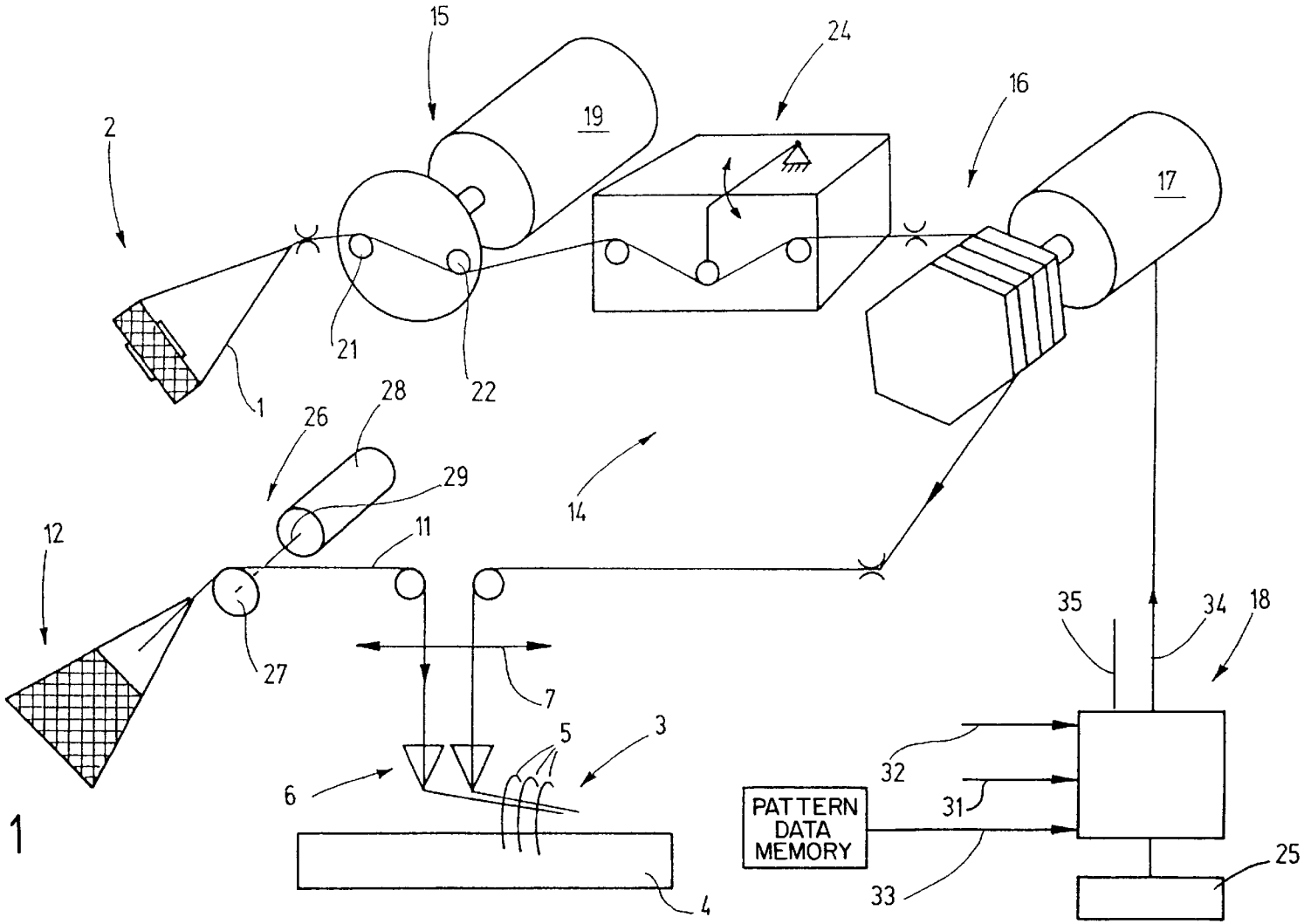
FIG. 1 shows a schematic basic illustration of a first embodiment of the yarn feeder device for feeding elastic yarns to a flatbed knitting machine.

The yarn feeder device schematically shown in FIG. 1 serves to feed elastic yarn 1 from a bobbin 2 to knitting stations 3 of a flatbed knitting machine 4. The knitting stations 3 are formed by individual needles 5, past which a yarn guide 6 moves in reciprocation (arrow 7). The yarn guide 6 is supplied with both the elastic yarn 1 and a hard yarn 11. The latter is drawn from a corresponding further bobbin 12.

The feeding of the hard yarn can be done positively, with a feeder mechanism (yarn feeder) not shown in further detail, or by the pulling action of the needles 5 during the knitting operation. The quantity of yarn 11 either fed or drawn off determines the mesh size. The yarn quantity is not constant over time. In the region of the turning points of the yarn guide 6, the yarn consumption briefly comes to a complete stop. The yarn consumption in the forward and return strokes is also different, at least whenever the distance between the yarn guide and the feeding devices changes as the yarn guide reciprocates.

The elastic yarn 1 is fed by the yarn feeder device 14, which includes a tensioning device 15 and a yarn feed wheel 16 that is driven by an electric motor 17. The yarn 1 wraps a few times around the yarn feed wheel 16 and is thus entrained by this wheel without slip. The yarn feed wheel thus determines the yarn quantity fed to the yarn guide 6. To define this quantity for the relaxed state of the yarn 1, the yarn 1 is tensed by the tensioning device 15 nearly to its maximal value, but at least to a value at which any changes in force cause hardly any further changes in length. To achieve this, both the wrap brake 15 and the electric motor 17 are connected to a control unit 18, which defines both the rpm of the motor 17 and the action of the tensioning device 15. The tensioning device 15 has a rotational adjuster 19, on the power takeoff side of which two bearing pegs 21, 22 are eccentrically supported. The yarn 1 wraps around these bearing pegs 21, 22 at an angle that is dependent on the rotary position of the rotational adjuster 19 and thus is controllable by the control unit 18.

Between the tensioning device 15 and the yarn feed wheel 16, there is a yarn tension sensor 24 which detects the yarn tension here. The yarn tension sensor 24 furnishes its measured value or data to the control unit 18, which may for instance be embodied as a microcomputer. The control unit 18, via an input device not otherwise shown, receives a set-point value for the tension of the yarn 1. This value can be stored in a memory cell 25 shown in FIG. 1. The set-point value is defined at a value at which the yarn has virtually reached its elongation limit. The control unit 18 controls the tensioning device 15, when the yarn feeder device 15 is in operation, such that the yarn 1 drawn from the yarn feed wheel 16 by the tensioning device 15 reaches the desired high set-point tension. If any deviation is found by the yarn tension sensor 24, the control unit 18 adjusts the tensioning device 15 accordingly.

Conversely, the motor 17 of the yarn feed wheel 16 is triggered to suit the actual yarn consumption. To determine that, a measuring device 26 is disposed in the travel path of the hard yarn 11; it includes a yarn sensor wheel 27 and for instance an incremental angle encoder 28, whose shaft 29 supports the yarn sensor wheel 27. The hard yarn 11 wraps around the yarn sensor wheel 27, which rotates in accordance with its speed. Thus the angle encoder 28 detects the yarn speed and furnishes signals accordingly, via a line not otherwise shown, to an input 31 of the closed-loop control unit 18.

A further input 32 of the closed-loop control unit 18 is connected to the yarn tension sensor 24 and receives a yarn tension signal from it. Pattern data or other kinds of control data having a characteristic value that characterizes the quantity of elastic yarn to be furnished from pattern data memory 40 are furnished to a further input 33 of the control unit 18. A first output 34 of the control unit 18 triggers the motor 17, while a second output 35 is connected to the tensioning device 15 and regulates it.

The yarn feeder device 14 described thus far functions as follows:

In operation, the yarn guide 6 of the flatbed knitting machine 4 reciprocates crosswise to the length of the goods being produced or the stroke determined by the width of the goods. The knitting stations forms by the needles 5 must be supplied with the same quantities, or quantities corresponding to one another, of elastic yarn 1 and hard yarn 11. Via the input 33, the control unit 18 receives at least information about the direction of motion of the yarn guide 6. In the ideal case, the control unit 18 also receives information about the yarn guide speed. This can be determined by position or speed measurement, or can be made available as a fixed or predetermined value. From the speed of the yarn guide and the direction of motion, the control unit 18 determines the lengthening or shortening of the applicable travel path for the yarn 1 and the yarn 11 that is brought about in the motion of the yarn guide 6. The speed of the yarn 11, detected by the measuring device 26, is a speed that results from the change in length of the yarn travel path and the yarn consumption at the needles. In the control unit 18, the portion ascribed to the change in length of the yarn travel path is known or can be determined from the yarn guide speed, so that from the measured value of the yarn travel speed, the actual yarn consumption can be determined and is determined accordingly.

With this value as the point of departure, the control unit 18 determines the quantity of elastic yarn required at the needles 5, for instance as a fixed ratio to the quantity of hard yarn 11 being processed by the needles 5. To this the control unit 18 adds or subtracts the yarn quantity that results from lengthening or shortening, respectively, of the travel path of the yarn 1. From the value thus obtained, control pulses are formed for triggering the motor 17 at an rpm corresponding to the resultant yarn feed quantity.

At the same time in parallel, and also independently of this process, the control unit 18, by means of the tensioning device 15, regulates the yarn tension upstream of the yarn feed wheel 16 to a defined value, which for example is high enough that the elastic yarn 1 is virtually completely stretched and thus behaves virtually like a hard yarn.

Figure 2:
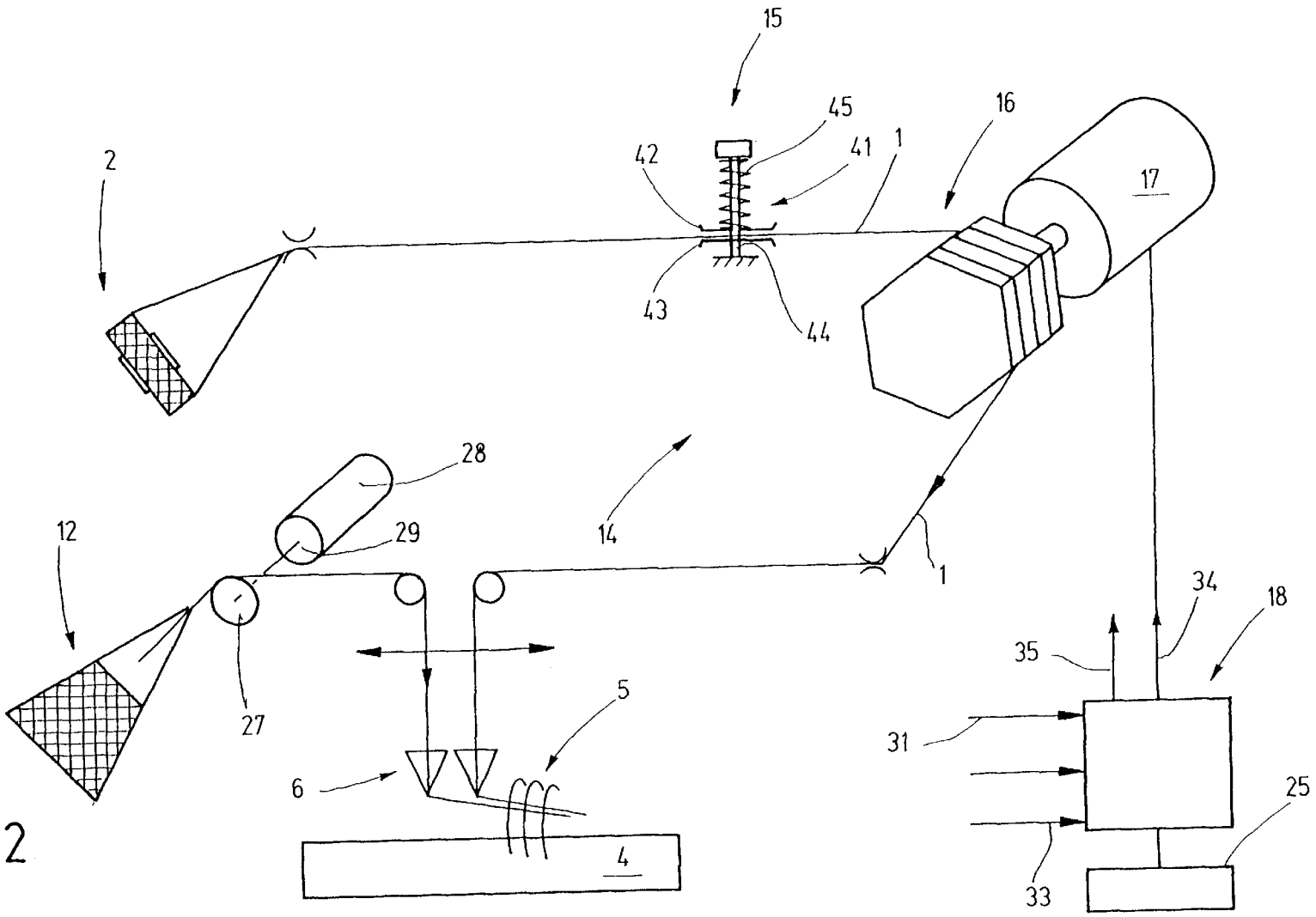
FIG. 2 shows a simplified embodiment of the yarn feeder device of FIG. 1.

In an alternative embodiment, shown in FIG. 2, the tensioning device 15 is formed by a yarn brake 41, which operates in unregulated fashion. The yarn brake 41 by way of example has two for instance disklike plates 42, 43 acting as brake elements, which are seated on a bolt 44 and are tensed against one another by means of a spring 45. The yarn 1 is clamped between the plates 42, 43 and can be pulled through them with friction. The yarn brake 41 is set fixedly to a yarn tension value that is high enough that the yarn 1, in the region between the yarn brake 41 and the yarn feed wheel 16, is stretched virtually completely, essentially independently of its travel speed. Accordingly, the yarn tension sensor 24 and the corresponding input 22 of the control unit 18 are omitted. Otherwise, this embodiment of the yarn feeder device 14 matches the yarn feeder device described above (FIG. 1) in its design and function. The same reference numerals are therefore used and the above description is referred to.

Figure 3:
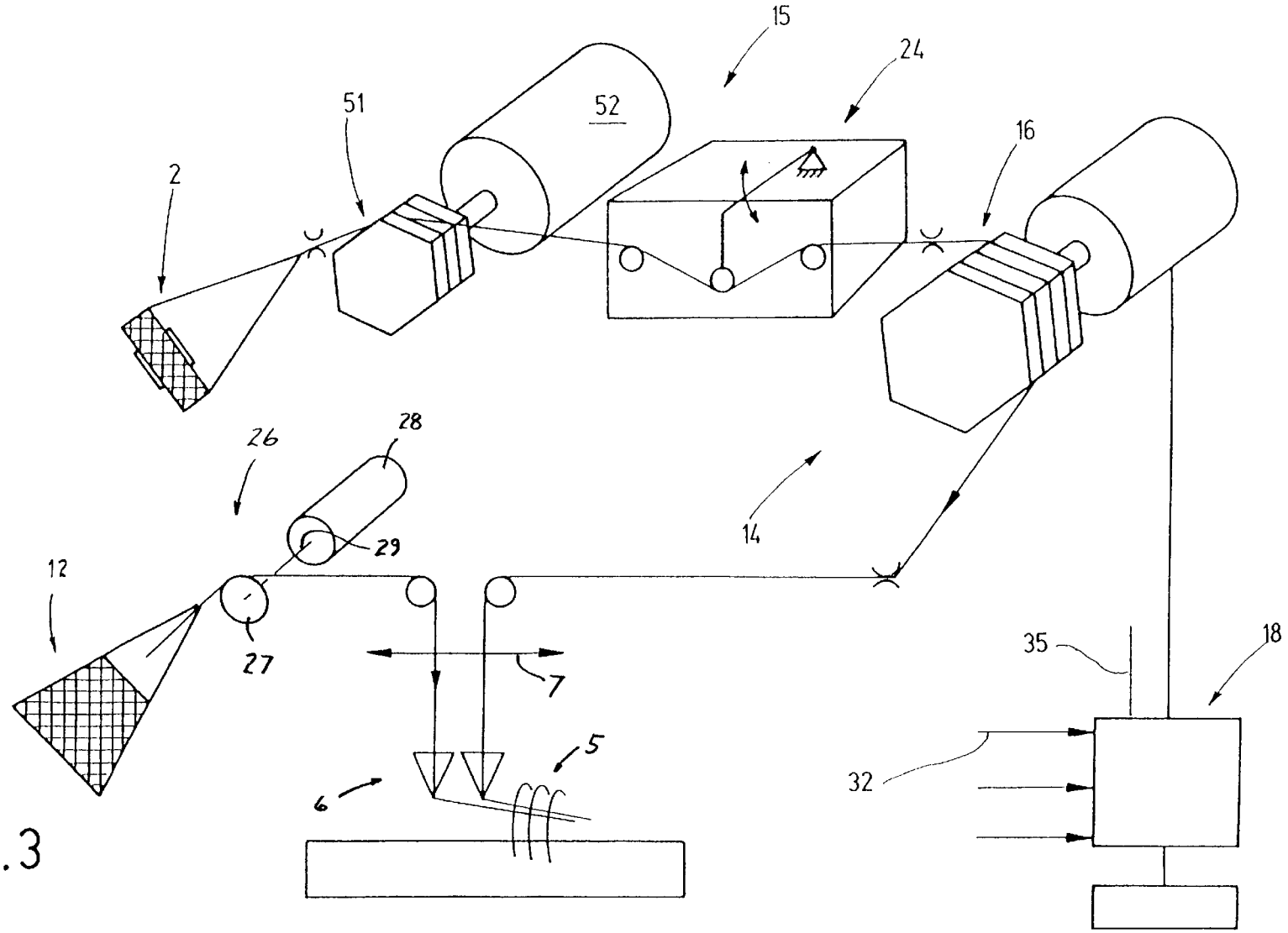
FIG. 3 shows a modified embodiment of the yarn feeder device.

A further modified embodiment of the yarn feeder device is seen in FIG. 3. The differences again reside in the tensioning device 15; for the rest, reference is made to the above description, which applies accordingly.

The tensioning device 15 of the yarn feeder device 14 of FIG. 3 has a yarn feed wheel 51, which is seated on the shaft of a further drive motor 52. The yarn feed wheel 51 is substantially equivalent to the yarn feed wheel 16, and like that wheel has the yarn 1 wrapped around it once or several times. The yarn tension sensor 24, which is connected to the input 32 of the control unit, is disposed between the yarn feed wheels 51, 16. The yarn tension sensor now, instead of the adjusting device 19, controls the drive motor 52, in such a way that the yarn 1 is drawn from the bobbin 2 and fed in such a way to the yarn feed wheel 16 that the desired high yarn tension is established until the yarn is stretched out. To that end, the control unit 18 emits trigger pulses accordingly at its output 35.

The advantage of this embodiment is the rapid buildup of the defined yarn tension between the two yarn feed wheels 52, 16 and the decoupling of the yarn tension, in this travel path, from external factors from the yarn path downstream of the positive feeder. This can be done as needed without rotation of the yarn feed wheel 16, if the yarn feed wheel 51 is triggered to rotate backward.

A yarn feeder device for feeding elastic (soft) yarns to a yarn consuming station with yarn demand that fluctuates over time has a control unit that ascertains the current yarn demand, or to which this demand is reported. In accordance with this demand, a yarn feed wheel is driven at an rpm corresponding to the yarn demand. The yarn reaches the yarn feed wheel via a tensioning device. The tensioning device is set such that the yarn is stretched, for instance virtually completely but in any case in a defined way. As a result, a fixed relationship between the desired yarn feeding quantity and the rpm of the yarn feed wheel is possible.

What is claimed is:

1. A yarn feeder device (14), in particular for elastic yarns (1), comprising:

a tensioning device (15), which exerts a force acting on the yarn in the longitudinal direction of the yarn that is arranged to stretch the yarn to a defined tension value;

a yarn feed wheel (16) around which the stretched yarn (1) can wrap and which receives the yarn in a few windings in such a way that the yarn tension upstream of the yarn feed wheel (16) does not influence the yarn tension downstream of the yarn feed wheel (16), or does so only insignificantly, and a motor (17), which is drivingly coupled to the yarn feed wheel (16) and is energized, independently of the tensioning device (15), in accordance with the current yarn demand and, independently of the tension of the yarn (1), in a segment downstream of the yarn feed wheel (16), characterized in that a yarn tension sensor (24) for detecting the yarn tension is disposed between the tensioning device (15) and the yarn feed wheel (16), and that the yarn tension is set by means of a controllable yarn brake (21, 22) on the basis of the yarn tension value ascertained by the yarn tension sensor (24).

2. A yarn feeder device (14), in particular for elastic yarns (1), comprising:

a tensioning device (15), which exerts a force acting on the yarn in the longitudinal direction of the yarn that is arranged to stretch the yarn to a defined tension value;

a yarn feed wheel (16) around which the stretched yarn (1) can wrap and which receives the yarn in a few windings in such a way that the yarn tension upstream of the yarn feed wheel (16) does not influence the yarn tension downstream of the yarn feed wheel (16), or does so only insignificantly, and a motor (17), which is drivingly coupled to the yarn feed wheel (16) and is energized, independently of the tensioning device (15), in accordance with the current yarn demand and, independently of the tension of the yarn (1), in a segment downstream of the yarn feed wheel (16), characterized in that the yarn brake (21, 22) is a friction brake with a fixed or adjustable load on its friction elements, and for loading the friction elements, an electrically controllable force generating device (19) is provided which is operatively connected to at least one of the friction elements.

3. A yarn feeder device (14), in particular for elastic yarns (1), comprising:

a tensioning device (15), which exerts a force acting on the yarn in the longitudinal direction of the yarn that is arranged to stretch the yarn to a defined tension value;

a yarn feed wheel (16) around which the stretched yarn (1) can wrap and which receives the yarn in a few windings in such a way that the yarn tension upstream of the yarn feed wheel (16) does not influence the yarn tension downstream of the yarn feed wheel (16), or does so only insignificantly, and a motor (17), which is drivingly coupled to the yarn feed wheel (16) and is energized, independently of the tensioning device (15), in accordance with the current yarn demand and, independently of the tension of the yarn (1), in a segment downstream of the yarn feed wheel (16), characterized in that the tensioning device (15) is a yarn brake (41), which generates the yarn tension essentially independently of the yarn travel speed, and the yarn brake (21, 22) is a wrapping brake with at least one wrapping element whose wrap angle can be varied by means of an adjusting device (18).

4. The yarn feeder device of claim 3, characterized in that to adjust the wrap angle, an electrically controllable device (19) is provided which is operatively connected to said at least one wrap element.

5. A yarn feeder device (14), in particular for elastic yarns (1), comprising:

a tensioning device (15), which exerts a force acting on the yarn in the longitudinal direction of the yarn that is arranged to stretch the yarn to a defined tension value;

a yarn feed wheel (16) around which the stretched yarn (1) can wrap and which receives the yarn in a few windings in such a way that the yarn tension upstream of the yarn feed wheel (16) does not influence the yarn tension downstream of the yarn feed wheel (16), or does so only insignificantly, and a motor (17), which is drivingly coupled to the yarn feed wheel (16) and is energized, independently of the tensioning device (15), in accordance with the current yarn demand and, independently of the tension of the yarn (1), in a segment downstream of the yarn feed wheel (16), characterized in that a yarn tension sensor (24) for detecting the yarn tension is disposed between the tensioning device (15) and the yarn feed wheel (16), and that the yarn tension is set by means of a controllable yarn brake (21, 22) on the basis of the yarn tension value ascertained by the yarn tension sensor (24), and yarn feed wheel (51) connected to an actuator device is disposed upstream of the yarn tension sensor (24) and the yarn (1) wraps around it, and its revolutions are controlled or regulated by the yarn tension sensor (24) in such a way that a substantially constant yarn tension is obtained at the yarn tension sensor (24).

6. The yarn feeder device of claim 5, characterized in that the actuator device is a motor (52).

7. A yarn feeder (14), in particular for elastic yarns (1), comprising:

a tensioning device (15), which exerts a force acting on the yarn in the longitudinal direction of the yarn that is arranged to stretch the yarn to a defined tension value;

a yarn feed wheel (16) around which the stretched yarn (1) can wrap and which receives the yarn in a few windings in such a way that the yarn tension upstream of the yarn feed wheel (16) does not influence the yarn tension downstream of the yarn feed wheel (16), or does so only insignificantly, and a motor (17), which is drivingly coupled to the yarn feed wheel (16) and is energized, independently of the tensioning device (15), in accordance with the current yarn demand and, independently of the tension of the yarn (1), in a segment downstream of the yarn feed wheel (16), characterized in that the yarn feeder device (14) has a control unit (18) or is connected to a control unit (18) that triggers the motor (17) in accordance with the desired yarn feed quantity.

8. The yarn feeder device of claim 7, characterized in that the control unit (18) is connected to a pattern data memory.

9. The yarn feeder device of claim 7, characterized in that the control unit (18) is connected to a sensor device (26) for detecting the yarn speed of one or more yarns (11) that specify the demand for elastic yarn (1).

10. The yarn feeder device of claim 9, characterized in that the sensor device (26) has a measuring wheel (27) and an angle encoder (28).

11. The yarn feeder device of claim 7, characterized in that the control unit (18) is connected to the tensioning device in order to regulate the yarn tension in accordance with a settable specification.

12. A method for feeding elastic yarns with specified yarn quantities which vary over time, comprising the steps of:

after being drawn from a bobbin, stretching the yarn to a defined value;

detecting at least one characteristic value that characterizes the current yarn quantity required;

after the stretching, delivering the yarn in the tensed state to a feeder device, which is arranged to feed the tensed yarn in accordance with the characteristic value.

13. A method of claim 12, characterized in that after being drawn from the bobbin, the yarn is stretched to a value at which any further increase in the force would no longer cause any significant further reversible increase in the yarn length.

* * * * *